US008602527B2

(12) United States Patent
Petersen et al.

(10) Patent No.: US 8,602,527 B2
(45) Date of Patent: Dec. 10, 2013

(54) PRINTHEAD ASSEMBLY

(75) Inventors: Daniel W. Petersen, Philomath, OR (US); Beverly A. Stonas, Albany, OR (US); Jonathan Paul Dye, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 114 days.

(21) Appl. No.: 13/097,295

(22) Filed: Apr. 29, 2011

(65) Prior Publication Data

US 2012/0274705 A1 Nov. 1, 2012

(51) Int. Cl.
*B41J 2/135* (2006.01)
*B41J 2/14* (2006.01)
*B41J 2/16* (2006.01)

(52) U.S. Cl.
USPC ..... 347/44; 347/50

(58) Field of Classification Search
USPC ..... 347/44, 50
See application file for complete search history.

(56) References Cited

U.S. PATENT DOCUMENTS 6,244,696 B1 6/2001 Tran et al.
6,364,475 B2 4/2002 Feinn et al.
7,600,850 B2 * 10/2009 Blackburn et al. ..... 347/20
7,658,470 B1 2/2010 Jones et al.

FOREIGN PATENT DOCUMENTS

WO WO-2009139773 11/2009

* cited by examiner

*Primary Examiner* — Matthew Luu
*Assistant Examiner* — Renee I Wilson
(74) *Attorney, Agent, or Firm* — Walter W. Karnstein

(57) ABSTRACT

An apparatus is provided, the apparatus including a printhead die, a base coupled to the printhead die, a flexible circuit mounted on the base and electrically connected to the printhead, and an adhesive sandwiched between the base and the flexible circuit. The base defines a trench with a sidewall having scallops formed therein. The adhesive is disposed in the trench to secure the flexible circuit to the base.

8 Claims, 6 Drawing Sheets

PRINTHEAD ASSEMBLY

BACKGROUND

An inkjet printing system may include a printhead, an ink supply which supplies liquid ink to the printhead, and an electronic controller which controls the printhead. The printhead ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other. The printhead may be connected to the electrical controller via a flex circuit, which may be secured to a base that carries the printhead. Typically, the flex circuit is secured to the base via an adhesive that may be sandwiched between the flex circuit and the base.

DETAILED DESCRIPTION

Figure 1:
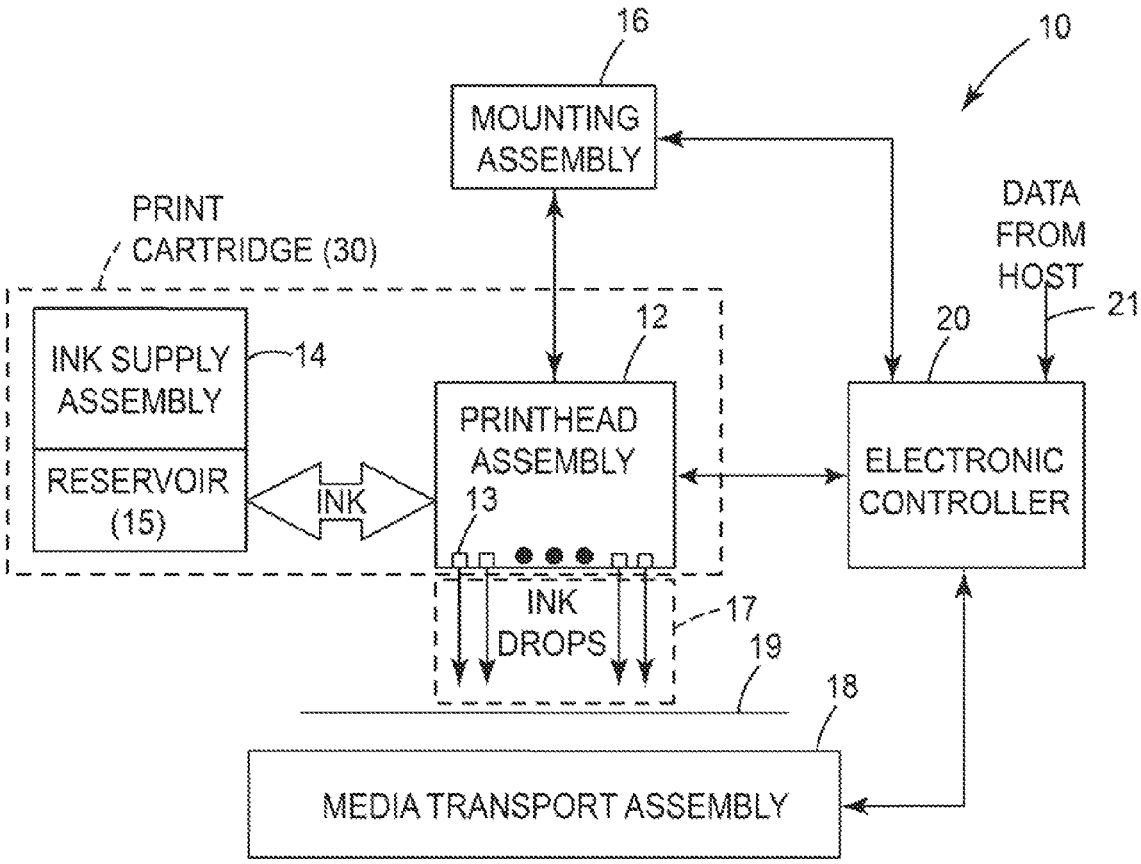
FIG. 1 is a block diagram illustrating an inkjet printing system according to an embodiment of the invention.

FIG. 1 illustrates an inkjet printing system 10 including a fluid ejection system employing a fluid ejection device, such as printhead assembly 12, and a fluid supply, such as ink supply assembly 14. In the illustrated example, inkjet printing system 10 also includes a mounting assembly 16, a media transport assembly 18, and an electronic controller 20.

Printhead assembly 12, as one example of a fluid ejection device, is formed according to an example of the present invention and ejects drops of printing fluid, such as black and colored inks, via a plurality of ejection elements 13. While the following description refers to the ejection of ink from printhead assembly 12, it is understood that other liquids, fluids, or flowable materials may be ejected from printhead assembly 12.

In one example, the drops are directed toward a medium, such as print media 19, so as to print onto print media 19. Typically, nozzles 13 are arranged in columns or arrays such that properly sequenced ejection of ink from the nozzles causes, in one example, characters, symbols, and/or other graphics or images to be printed upon print media 19 as printhead assembly 12 and print media 19 are moved relative to each other.

Print media 19 includes, for example, paper, card stock, envelopes, labels, transparent film, cardboard, rigid panels, and the like. In one example, print media 19 is a continuous form or continuous web print media 19. As such, print media 19 may include a continuous roll of unprinted paper.

Ink supply assembly 14, as one example of a fluid supply, supplies ink to printhead assembly 12 and includes a reservoir

15 for storing ink. As such, ink flows from reservoir 15 to printhead assembly 12. In some examples, ink supply assembly 14 and printhead assembly 12 may form a recirculating ink delivery system. As such, ink may flow back to reservoir 15 from printhead assembly 12. Printhead assembly 12 and ink supply assembly 14 may be housed together in a print cartridge or pen, as identified by dashed line 30. In some examples, the ink supply assembly may be separate from the printhead assembly, and may supply ink to the printhead assembly through an interface connection, such as a supply tube (not shown).

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined in an area between printhead assembly 12 and print media 19. During printing, print media 19 is advanced through print zone 17 by media transport assembly 18.

Printhead assembly 12 may take the form of a scanning-type printhead assembly, where mounting assembly 16 moves printhead assembly 12 relative to media transport assembly 18 and print media 19 during printing of a swath on print media 19.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

Electronic controller 20 typically provides control of printhead assembly 12 including timing control for ejection of ink drops by ejection elements 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one example, logic and drive circuitry forming a portion of electronic controller 20 is located on printhead assembly 12. In another example, logic and drive circuitry forming a portion of electronic controller 20 is located off printhead assembly 12.

Although not shown in FIG. 1, inkjet printing system 10 may include a printhead servicing assembly, such as a priming assembly, or the like. As will be described further below, printing device 10 is configured to reduce leakage during priming to enhance effectiveness of priming and to reduce cross-contamination.

Figure 2:
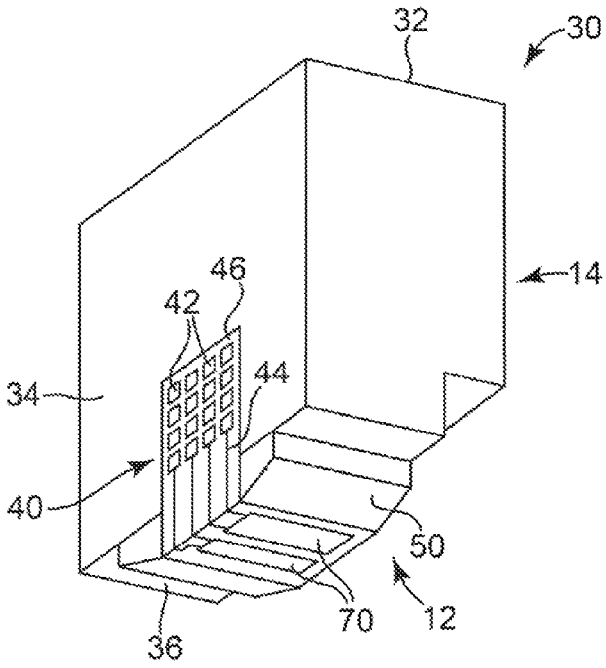
FIG. 2 is a perspective view illustrating an inkjet print cartridge according to an embodiment of the invention.

Turning now to FIG. 2, an example print cartridge is shown at 30, the print cartridge including a printhead assembly 12 and a printing fluid supply in the form of ink supply assembly 14. The printhead assembly and ink supply cartridge may be coupled or joined together to form print cartridge 30. Print cartridge 30 thus may include a body or housing 32 which supports printhead assembly 12 and contains reservoir 15 (FIG. 1) of ink supply assembly 14. As such, reservoir 15 communicates with printhead assembly 12 to supply ink to printhead assembly 12. In other examples, body 32 may receive fluid from a remote fluid supply.

As shown in FIG. 2, housing 32 also supports an electrical circuit 40, which facilitates communication of electrical signals between electronic controller 20 (FIG. 1) and printhead assembly 12 for controlling and/or monitoring operation of printhead assembly 12. Electrical circuit 40 includes a plurality of electrical contacts 42 and a plurality of conductive paths 44, which extend between and provide electrical connection between electrical contacts 42 and printhead assembly 12. Electrical contacts 42 provide points for electrical connection with print cartridge 30 and, more specifically, with printhead assembly 12. As such, electrical contacts 42 facilitate communication of power, ground, and/or data signals to printhead assembly 12. In some examples, electrical circuit 40 may be supported by print cartridge 30 such that electrical contacts 42 are provided along a side 34 of housing 32 of print cartridge 30.

Electrical circuit 40 may be a flexible electrical circuit. As such, conductive paths 44 may be formed in one or more layers of a flexible base material 46. Base material 46 may include, for example, a polyimide or other flexible polymer material (e.g., polyester, poly-methyl-methacrylate) and conductive paths 44 may be formed of copper, gold, or other conductive material.

Printhead assembly 12 is a modular printhead assembly formed of separate components including a base 50, one or more substrates 60 (FIG. 3), and one or more printhead die 70. Base 50 and substrates 60 mate with each other and are configured such that base 50 and substrates 60 provide mechanical support for and accommodate fluidic routing to printhead die 70.

In the present example, housing 32 includes isolated internal chambers (collectively referred to as reservoir 15) for supplying distinct fluids to the printheads. A first color of ink thus may be supplied to one printhead, while a second distinct color of ink may be supplied to another printhead. In some examples, plural colors may be supplied to a single printhead. For purposes of this disclosure, with reference to inks, the term "color" includes black inks.

Figure 3:
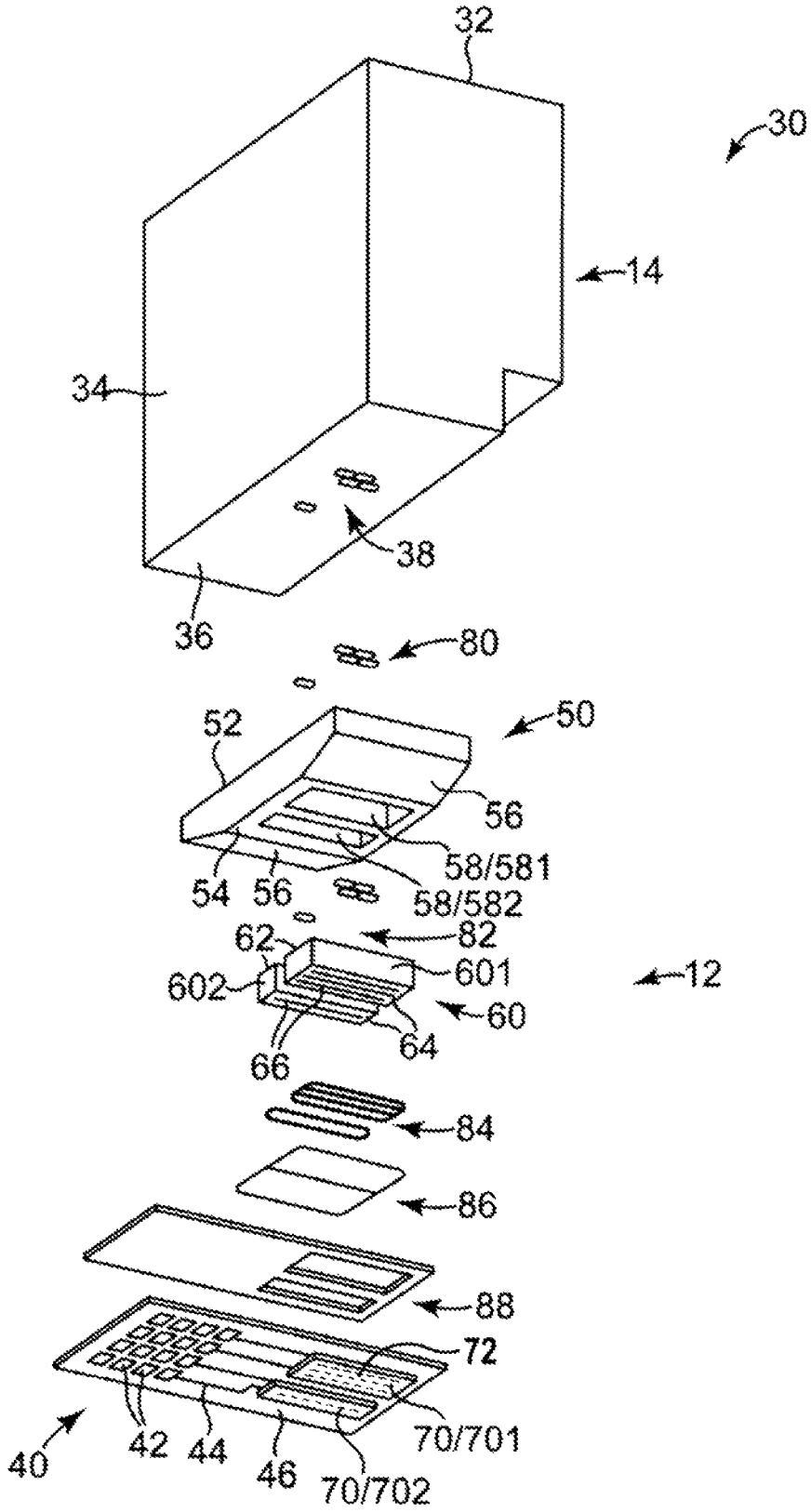
FIG. 3 is an exploded perspective view showing the inkjet print cartridge of FIG. 2.

Referring now to FIGS. 2 and 3, base 50 has a first side surface 52 and a second side surface 54, which is opposite first side surface 52. In one example, base 50 is supported by housing 32. More specifically, first side surface 52 of base 50 is secured to or mounted on a side 36 of housing 32. Fluid outlets 38 (in fluid communication with the internal chambers of reservoir 15 (FIG. 1)) are provided on side 36 of housing 32. Base 50 is mounted on side 36 of housing 32 so as to accommodate fluidic coupling with housing 32 and/or communicate with fluid outlets 38.

Base 50 is secured to or mounted on housing 32 so as to provide a fluid-tight seal with housing 32. For example, first side surface 52 of base 50 may be secured to or mounted on side 36 of housing 32 by use of an adhesive 80 provided between base 50 and housing 32. Other connection methods providing a fluid-tight seal between base 50 and housing 32 may also be used.

In one example, base 50 further includes ramped surfaces 56. Ramped surfaces 56 are provided on opposite ends of second side surface 54 of base 50 and aid in preventing crashes between printhead assembly 12 and print media 19 (FIG. 1) as printhead assembly 12 and print media 19 are moved relative to each other during printing.

Base 50 defines one or more pockets 58 into which one or more substrates 60 are fit. Pockets 58 are open at least to second side surface 54 of base 50, and are sized and configured to receive and support substrates 60. Although base 50 is illustrated and described herein as having two pockets 581, 582, each receiving and supporting one substrate 601, 602, it is within the scope of the present invention for base 50 to have any number of pockets 58, each receiving and supporting one or more substrates 60.

As indicated in FIG. 3, substrates 60 each have a first side surface 62, and a second side surface 64, which is opposite first side surface 62. Substrates 60 are fit or received within respective pockets 58 of base 50. More specifically, substrates 60 are fit or received within pockets 581, 582 such that second side surface 64 of each substrate 601, 602 is adjacent second side surface 54 of base 50. As such, pockets 581, 582 position substrates 601, 602 relative to housing 32, and position substrates 601, 602 for supporting printhead dies 701, 702. In some examples, pockets 58 and/or substrates 60 include features (e.g., datum pads and/or lockout features) to ensure correct orientation and retention (e.g., press fit) of substrates 60 within pockets 58.

Substrates 601, 602 may be formed of a plastic, ceramic, glass, or other suitable material. When substrates 601, 602 are formed of a plastic material, filler materials such as glass, carbon fibers, minerals, or other suitable filler materials may also be used. In addition, substrates 601, 602 may be formed by a number of methods such as injection molding, pressing, machining, or etching depending on the substrate material.

Substrates 601, 602 are secured or mounted within pockets 581, 582 so as to provide a fluid-tight seal with base 50. For example, first side surface 62 of each substrate 601, 602 may be secured or mounted within a corresponding pocket 581, 582 by use of an adhesive 82 provided between substrates 601, 602 and base 50. Other connection methods providing a fluid-tight seal between substrates 60 and base 50 also may be used.

An area or footprint of each substrate 601, 602 may be approximately the same as an area or footprint of a respective printhead die 701, 702 to provide support for the respective printhead die 701, 702. More specifically, a length and a width of second side surface 64 of each substrate 601, 602 approximates (or is substantially equal to) a length and a width of a respective printhead die 701, 702. In addition, substrates 601, 602 have fluid passages 66 formed therethrough. Fluid passages 66 communicate with first side surface 62 and second side surface 64 of substrates 601, 602 and provide fluidic routing for printhead dies 701, 702.

In one example, each printhead die 701, 702 includes a thin-film structure formed on a die substrate. The die substrates are formed, for example, of silicon, glass, or a stable polymer, and the thin-film structure includes a conductive layer and one or more passivation or insulation layers.

Each printhead die 701, 702 defines a one or more fluid slots (not shown), which communicate printing fluid from printing fluid supply 14 to ejection elements 13 (FIG. 1) formed on the printhead die. The ejection elements, in turn, eject fluid through nozzles of corresponding nozzle arrays 72. Each nozzle array 72 may be associated with a different printing fluid, according to the particular printing parameters desired. Although nozzle arrays 72 are shown as each including a single column of nozzles, each nozzle array may include one, two or more columns of nozzles fed by a single fluid slot. Other nozzle configurations also are possible.

Printhead dies 701, 702 may be joined with or mounted on flexible circuit 40 such that printhead dies 701, 702 and electrical circuit 40 are supported by substrates 601, 602, respectively, and base 50. In some examples, a portion of flexible circuit 40 extends beneath or underlies a printheads dies 701, 702, facilitating connection between flexible circuit 40 and printhead dies 701, 702. Flexible circuit 40 bends and wraps around and is supported by side 34 of housing 32 of print cartridge 30. Flexible circuit 40 is coupled to or retained along a side or sides of housing 32 so as to not interfere with printing. In some examples, a printed circuit assembly, or "PCA", (not shown) may be rigidly mounted to housing 32, and flexible circuit 40 may be soldered to the PCA. Contact Pads 42 thus may be included on the PCA, rather than on flexible circuit. In such a configuration, the PCA may be rigidly affixed to side 34 of housing 32 using screws, swage posts, or other structure.

Flexible circuit 40 may have various configurations. For example, flexible circuit 40 may have openings underlying printhead dies 701, 702 to provide for communication of printing fluids into the printheads. In some examples, flexible circuit 40 may define a separate opening underlying each printhead die 701, 702. In other configurations, the flexible circuit may define a single opening, underlying portions of multiple printhead dies. In still other configurations, flexible circuit 40 may not extend completely about and on all sides of the printhead dies.

Printhead dies 701, 702 are secured to or mounted on substrates 601 and 602 so as to provide a fluid-tight seal between substrates 601, 602 and base 50. For example, printhead dies 70 may be secured to (or mounted on) second side surface 64 of substrates 601, 602 by use of an adhesive 84 provided between printhead dies 701, 702 and substrates 601, 602. Similarly, flexible circuit 40 is secured to or mounted on second side surface 54 of base 50 by use of an adhesive 86 provided between flexible circuit 40 and base 50, and may be generally planar so as to accommodate flat placement of flexible circuit 40 thereon. Second side surface 54 thus also may be referred to as a flex-mounting surface. In one example, a heat-staked attach layer 88 may be interposed between flexible circuit 40 and base 50. Other connection methods providing a fluid-tight seal between printhead dies 70 and substrates 60, and between flexible circuit 40 and base 50 also may be used.

Figure 4:
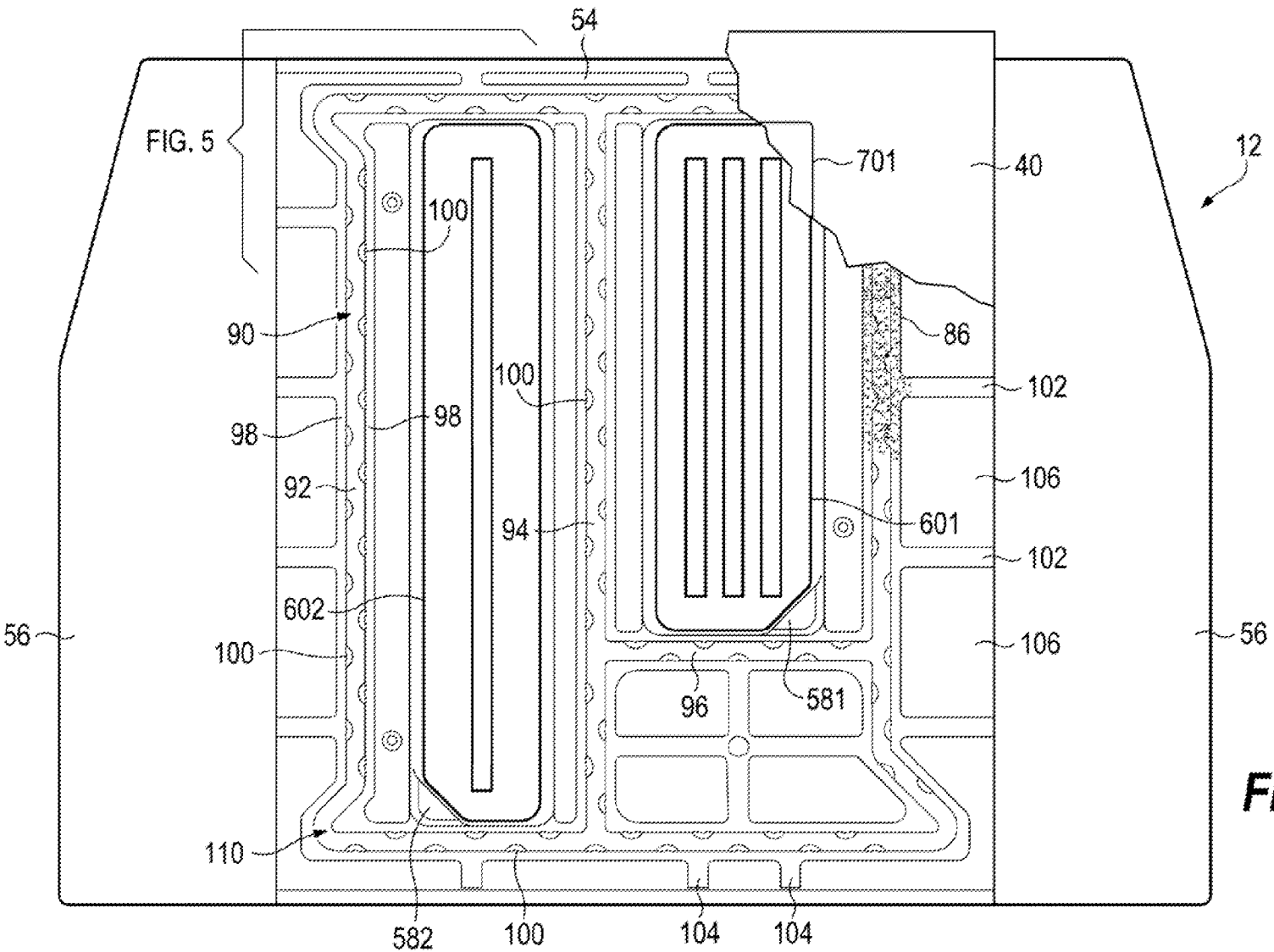
FIG. 4 is a plan view showing a print cartridge base configured to receive a flex circuit according to an embodiment of the invention.

FIG. 4 is a plan view of printhead assembly 12, with portions fragmented and/or omitted for purposes of illustration. As indicated, base 50 defines pockets 581, 582, each of which receives a substrate 601, 602 that provide fluidic routing for corresponding printheads 701, 702 (FIG. 3). Although the present example references two printheads, one or more printheads may be employed, and may be arranged in any of a variety of different printhead configurations.

As indicated above, flexible electrical circuit 40 may be secured to base 50 via an adhesive 86 (shown in fragment in FIG. 4). Adhesive 86 may be a layer or bead of solidified adhesive paste sandwiched between flexible circuit 40 and flex-mounting surface 54 of base 50. As will be explained further below, the adhesive bead extends at least partially about a perimeter of pockets 581, 582, and correspondingly, about substrates 601, 602 (received in such pockets) and printhead dies 701. 702 (mounted on the substrates). In the illustrated example, adhesive 86 extends continuously about both printhead dies 701, 702, collectively, while being sandwiched between base 50 and flexible circuit 40.

Adhesive 86 may have sufficiently low viscosity, prior to curing or solidification, such that the adhesive may flow into or gaps or voids in flex-mounting surface 54, as well as into gaps or voids in an exterior surface of flexible circuit 40. In addition, adhesive 86 may accommodate surface irregularities or non-flatness associated with flex-mounting surface 54. As a result, upon curing or other solidification, adhesive 86 may form a hermetic seal between flex-mounting surface 54 and the opposing portion of flexible circuit 40. The seal formed by adhesive 86 between flex-mounting surface 54 (of base 50) and flexible circuit 40 inhibits airflow or fluid flow between flexible circuit 40 and base 50. Consequently, priming may be enhanced and cross-contamination of different fluids between printhead dies 701, 702 may be reduced.

In one example, adhesive 86 has a viscosity at room temperature of less than or equal to about 200,000 centipoise (cp). The adhesive material may, for example, be an epoxy paste (which may not need mixing, but which may utilize a curing process step). Adhesive 86 may be Bisphenol A thermosetting epoxy. Other types of adhesive may be used.

Adhesive 86 may be placed between flex-mounting surface 54 and flexible circuit 40 in various manners. For example, the adhesive may be initially deposited upon flexible circuit 40, and flexible circuit 40 then may be pressed against base 50, bringing adhesive 86 into contact with flex-mounting surface 54. In another example, adhesive 86 may be initially deposited on flex-mounting surface 54, and flexible circuit 40 may be pressed into contact with the paste on flex-mounting surface 54.

Adhesive 86 may be applied by various techniques, including but not limited to, robot needle dispensing, showerhead dispensing, manual needle dispensing, silk screening, or patterned preforms. With patterned preforms, the adhesive material may be in a non-paste state upon both sides of the preform, and the preform may be treated, such as with the application of heat, so as to cause the adhesive material on the preform or backing to change to a paste state. Once in the paste state, the adhesive paste material on the preform may be pressed into contact with either flex-mounting surface 54 or flexible circuit 40 prior to being joined to the other of flex-mounting surface 54 or flexible circuit 40.

As also noted above, because adhesive 86 has low viscosity, the adhesive will flow into gaps or voids in flex-mounting surface 54. Accordingly, flex-mounting surface 54 may be contoured with surface features that enhance adhesion of adhesive 86. FIG. 4 illustrates an example surface feature in the form of a rail 90, the rail defining a pattern that extends continuously about both of substrates 601, 602 (corresponding to the positions of printhead dies 701, 702). In particular, rail 90 includes a closed loop 92 extending continuously about both substrates, and a segment 94 extending between the substrates 601, 602 and interconnecting opposite sides of loop 92. Additional segments, such as intermediate segment 96, also may be employed to ensure that the pattern surrounds each substrate in close proximity to the substrate.

Flex-mounting surface 54 may further define a trench 98 on one or both sides of rail 90. Rail 90 thus may serve as a sidewall of the trench (with flexible circuit support features 106 defining an opposite sidewall of the trench. Trench 98 typically forms a continuous path around the printhead dies, and may form an independent continuous path around each printhead die. Adhesive 86 thus may be applied onto rail 90 and/or into trench 98 (between sidewalls of trench 98) to form a continuous seal around the printhead dies, and potentially, between the printhead dies to isolate the printhead dies from one another. However, in some examples, trench 98 may form a less than continuous path around the printhead dies.

Upon application of adhesive 86 (and/or upon corresponding placement of flexible circuit 40 on flex-mounting surface 54), excess adhesive may flow into trench 98. Trench 98 generally limits or contains the extent to which excess adhesive 86 may migrate prior to partial or complete solidification. Trench 98 further provides flexible circuit 40 with a greater degree of flatness or levelness. In particular, adhesive 86 (prior to solidification) is directly deposited onto rail 90 of flex-mounting surface 54 so as to contact and seal against flexible circuit 40. As flexible circuit 40 and flex-mounting surface 54 are pressed against one another (prior to curing or solidification of the adhesive), trenches 98 serve to contain excess adhesive displaced from rail 90. Trenches 98 thus enable a greater volume of the adhesive 86 to be applied without a corresponding unevenness of flexible circuit 40 being created. Flexible circuit 40 may have a greater degree of parallelism with flex-mounting surface 54. As a result, adhesive displaced from the top of rail 90 to the sides of rail 90 and into the adjacent trenches 98 may enhance subsequent sealing against flexible circuit 40 during priming and may permit printhead assembly to be positioned closer to media during printing.

Flex-mounting surface 54 also may define side channels 102 and/or end channels 104. Channels 102, 104 extend from trenches 98 on one or both sides of rail 90. Channels 102, 104 serve to vent air from the trenches 98. Channels 102, 104 help to prevent a breach of the adhesive 86, which could lead to a leak between die pockets or die pockets and atmosphere during priming of the print head.

According to one example embodiment, trench 98 has a width of between approximately 0.25 millimeters and approximately 2 millimeters (nominally about 0.4 millimeters) and a depth of between approximately 0.1 millimeters and approximately 2 millimeters (nominally about 0.4 millimeters). In other examples, trench 98 may have other widths or depths depending upon the desired amount of adhesive 86 that is to be used.

As indicated in FIG. 4, adhesive also will flow into adhesion-enhancing features, such as scallops 100. Such adhesion-enhancing features, and particularly scallops 100, add substantially to the shear surface of the rail 90 in contact with the adhesive, and thus may significantly improve adhesion of the flexible circuit 40 to base 50. Accordingly, once cured, the adhesive will tend to lock the flexible circuit 40 in place on flex-mounting surface 54.

Figure 5:
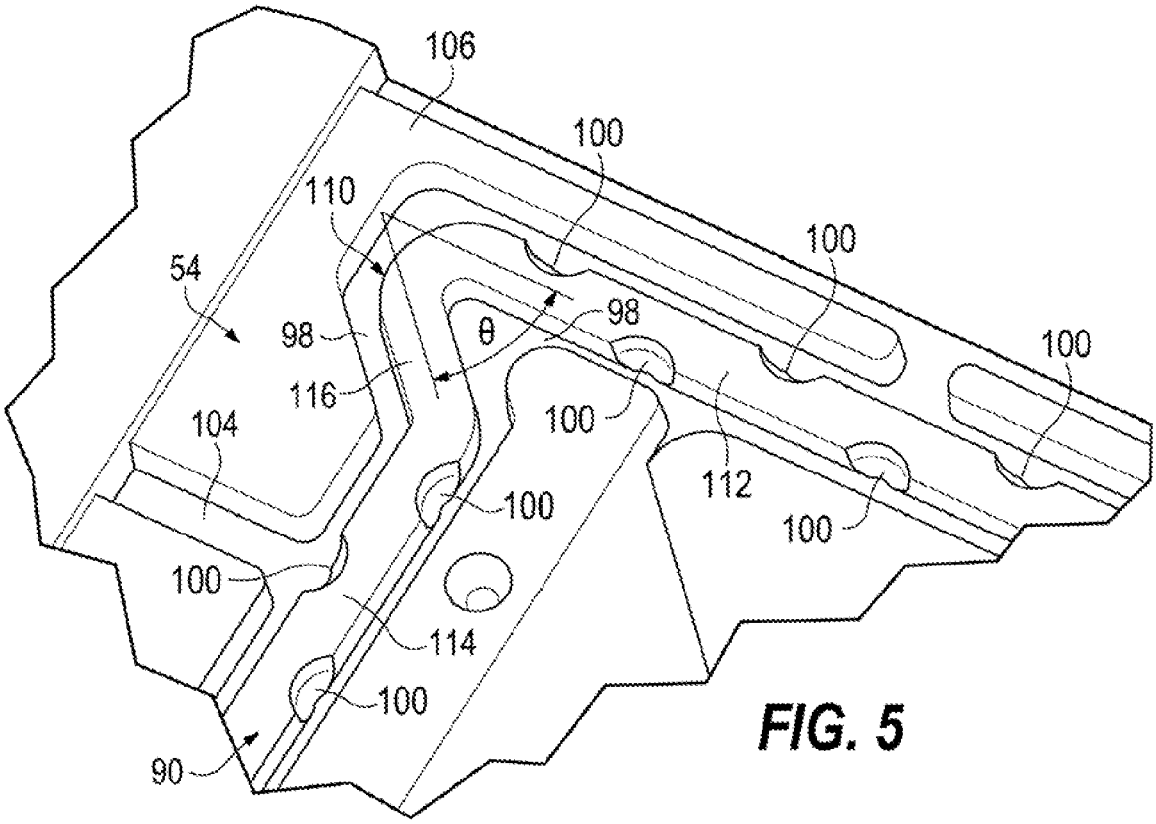
FIG. 5 is an enlarged fragmentary perspective view showing an example sealing zone of a print cartridge base.

Referring to FIGS. 4 and 5, it will be noted that scallops 100 may take the form of scalloped recesses formed in rail 90. In the present example, rail 90 defines plural scalloped recesses 100 generally equidistantly positioned along linear runs of rail 90, and in fluid communication with trench 98. More particularly, scallops 100 may be formed along substantially the entire length of rail 90, including along loop 92 and along segments 94, 96. Scallops 100 may add substantially to the shear surface of the rail 90 that is in contact with the adhesive, and thus may significantly improve adhesion of the flexible circuit to base 50.

Where rail 90 is formed with trenches 98 on opposite sides of the rail, scallops 100 similarly may be formed on opposite sides of the rail. Scallops on opposite sides of the rail may be offset from one another as shown to preserve structural integrity of the rail. Although not particularly shown, scallops 100 may additionally (or alternatively) be formed in cheeks 106, or in other flexible circuit support features adjacent trench 98.

In one example, scallops 100 are semi-spherical recesses formed in rail 90. Semi-spherical recesses 100 may be formed in rail 90 to tangentially intersect an adjacent trench floor. In one particular example, semi-spherical recesses 100 each have a radius of approximately 0.5 millimeters, and are spaced from each other by approximately 2.7 millimeters along each side of rail 90. Rail 90 may have a width of approximately 0.8 millimeters and a height of approximately 0.4 millimeters above the trench floor. In other examples, scallops 100 may have other shapes and/or dimensions.

As shown in FIG. 4, rail 90 (and trench 98) may include additional adhesion-enhancing features in areas where lift of flexible circuit 40 is a concern. Such adhesion-enhancing features may take the form of chicanes 110, such as those shown in the corners of flex-mounting surface 54. Because adhesive 86 follows rail 90 (and trench 98), the extra corner turns established by chicanes 110 effectively increase the amount of adhesive 86 in the corners of flex-mounting surface 54. This, in turn, reduces the potential for detachment of flexible circuit 40 (which is secured to flex-mounting surface 54 via adhesive 86), and is accomplished without negative impact on the flatness of flexible circuit 40 on flex-mounting surface 54.

In the present example, chicanes 110 are arranged so as not to impact height of base 50. More particularly, referring to FIG. 5, rail 90 includes a transverse segment 112 that extends beyond a longitudinal segment 114, before turning back toward longitudinal segment 114 via a return segment 116. Return angle θ (defined between transverse rail portion 112 and return rail portion 116) typically is an acute angle, selected so as to minimize impact on the adhesive application procedure. In one particular example, return angle θ is approximately 45 degrees. In other examples, other return angles, and/or other chicane shapes may be used.

Figure 6:
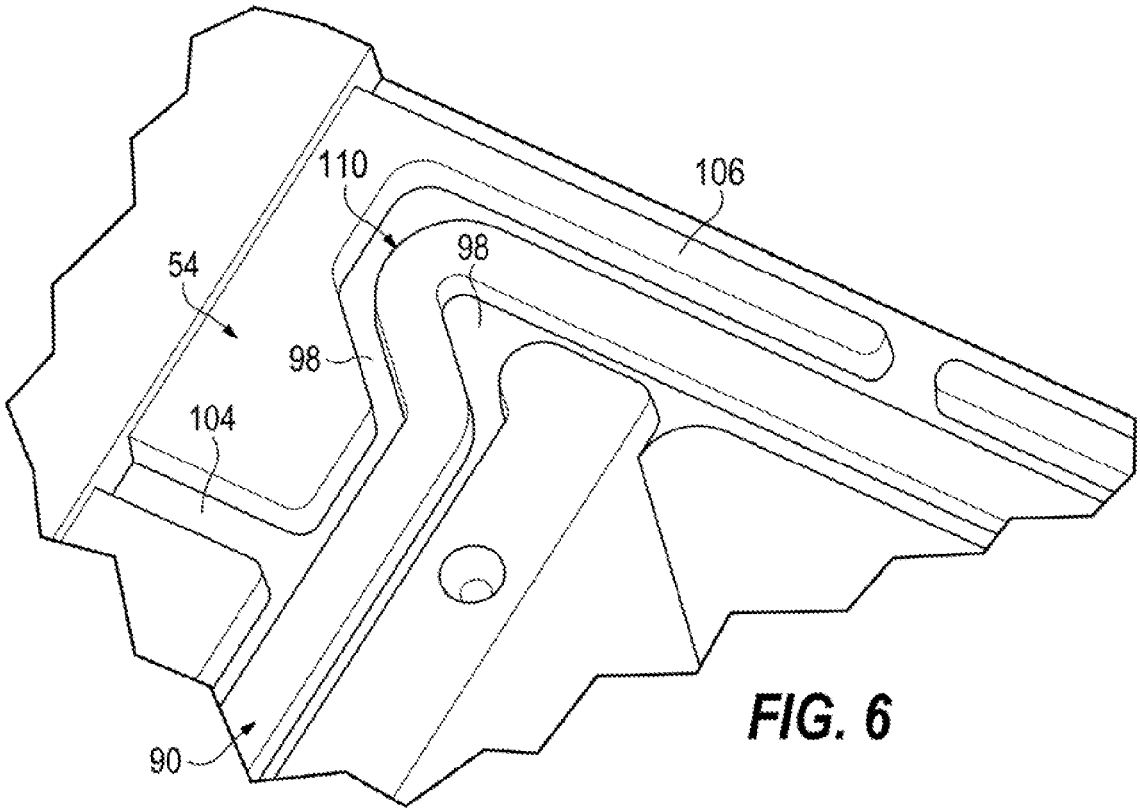
FIG. 6 is an enlarged fragmentary perspective view showing another example sealing zone of a print cartridge base.

As shown in FIGS. 5 and 6, rail 90 may be employed with or without scallops 100. Furthermore, chicanes 110 need not necessarily be employed in all four corners of flex-mounting surface 54. Chicanes 110 may be employed in fewer than all four corners, or may be employed at other positions along loop 92, segment 94 and/or intermediate segment 96. Chicanes 110 thus may be positioned in various locations on flex-mounting surface 54, where lift of flexible circuit 40 is a concern.

Although the present disclosure has been described with reference to examples, changes may be made in form and detail without departing from the spirit and scope of the subject matter. For example, although different examples may have been described as including one or more features providing one or more benefits, it is contemplated that the described features may be interchanged with one another or alternatively be combined with one another in the described examples or in other alternative examples.

What is claimed is:

1. An apparatus comprising:

a printhead die;

a base coupled to the printhead, the base defining a trench with a sidewall having a plurality of scalloped recesses formed therein;

a flexible circuit mounted on the base and electrically connected to the printhead die; and an adhesive sandwiched between the base and the flexible circuit, the adhesive being disposed in the trench to secure the flexible circuit to the base.

2. The apparatus of claim 1, wherein the recesses are equidistantly spaced along the trench.

3. The apparatus of claim 2, wherein the recesses are semi-spherical.

4. An apparatus comprising:

a printhead die;

a base coupled to the printhead, the base defining a trench with a sidewall having scallops formed therein, wherein the sidewall of the trench defines a chicane;

a flexible circuit mounted on the base and electrically connected to the printhead die; and an adhesive sandwiched between the base and the flexible circuit, the adhesive being disposed in the trench to secure the flexible circuit to the base.

5. The apparatus of claim 4, wherein the sidewall of the trench includes a transverse segment and a longitudinal segment, the chicane being disposed at an interface of the transverse segment and the longitudinal segment.

6. The apparatus of claim 5, wherein the transverse segment extends beyond the longitudinal segment, and turns back toward the longitudinal segment via a return segment to define the chicane.

7. The apparatus of claim 6, wherein the transverse segment and the return segment form an acute return angle.

8. The apparatus of claim 7, wherein the return angle is approximately 45 degrees.

* * * * *